US005544692A

United States Patent [19]

McMichael

[11] Patent Number: 5,544,692

[45] Date of Patent: Aug. 13, 1996

[54] CURTAIN DRAPING HARDWARE AND METHOD FOR DRAPING CURTAINS

[75] Inventor: Dannie L. McMichael, West Kingston, R.I.

[73] Assignee: Kenney Manufacturing Company, Warwick, R.I.

[21] Appl. No.: 420,628

[22] Filed: Apr. 12, 1995

Related U.S. Application Data

[63] Continuation of Ser. No. 101,498, Aug. 3, 1993, abandoned.

[51] Int. Cl.[6] ..... A47H 1/00

[52] U.S. Cl. ..... 160/349.2; 160/38

[58] Field of Search ..... 160/349.1, 349.2, 160/330, 38, 39, 399, 402, 405, 327

[56] References Cited

U.S. PATENT DOCUMENTS

| | | | |
|---|---|---|---|
| 740,684 | 10/1903 | Needham . | |
| 795,122 | 7/1905 | Henry | 160/402 |
| 825,665 | 7/1906 | Kram | 160/402 X |
| 827,000 | 7/1906 | Dinsmore | 160/349.2 X |
| 1,462,171 | 7/1923 | Greninger . | |
| 2,190,764 | 2/1940 | Arnold | 160/349.2 |
| 2,236,017 | 3/1941 | Stratton | 160/349.2 X |
| 2,244,129 | 6/1941 | Stratton | 160/349.2 X |
| 2,316,337 | 4/1943 | Kenney | 160/330 |
| 2,337,950 | 12/1943 | Werner et al. | 160/330 |
| 2,431,934 | 12/1947 | Higgins | 160/349.2 |
| 2,470,422 | 5/1949 | Wright | 160/84 |
| 2,862,549 | 12/1958 | Robbins | 160/38 |
| 3,138,197 | 6/1964 | Knowlton | 160/383 |
| 3,213,926 | 10/1965 | Seckerson | 160/402 |
| 3,378,057 | 4/1968 | Synck | 160/39 |
| 3,399,711 | 9/1968 | Stulac et al. | 160/330 |
| 3,693,210 | 9/1972 | MacFarlane et al. | 16/87 |
| 3,822,734 | 7/1974 | Tombu | 160/383 |
| 4,213,492 | 7/1980 | Guebert et al. | 160/330 X |
| 4,284,258 | 8/1981 | Kleiman | 248/251 |
| 4,958,646 | 9/1990 | Hannerstig | 160/348 |
| 4,960,161 | 10/1990 | Easley | 160/330 X |
| 5,012,851 | 5/1991 | Hannerstig | 160/348 |
| 5,018,567 | 5/1991 | Hannerstig | 160/348 |
| 5,074,348 | 12/1991 | Phillips | 160/38 |
| 5,090,095 | 2/1992 | Lightfoot | 160/330 X |
| 5,092,384 | 3/1992 | Easley | 160/38 X |
| 5,141,045 | 8/1992 | Williams | 160/348 |
| 5,146,972 | 9/1992 | Tacchella | 160/330 |
| 5,238,044 | 8/1993 | Gilley et al. | 160/349.1 X |

FOREIGN PATENT DOCUMENTS 2225232 5/1990 United Kingdom .

*Primary Examiner*—David M. Purol

*Attorney, Agent, or Firm*—Fish & Neave; Richard A. Inz

[57] ABSTRACT

Curtain draping hardware and a method for draping a curtain using a curtain rod and a curtain holder. The curtain covers the curtain rod and can be made to form one or two vertical tails and/or one or more arcs or swags by placement of the curtain in one or more curtain holders. A decorative accent piece can also be attached to the front of the curtain rod above the curtain holder.

22 Claims, 3 Drawing Sheets

CURTAIN DRAPING HARDWARE AND METHOD FOR DRAPING CURTAINS

This is a continuation, of application Ser. No. 08/101,498, filed Aug. 3, 1993 entitled CURTAIN DRAPING HARDWARE AND METHOD FOR DRAPING CURTAINS now abandoned.

BACKGROUND OF THE INVENTION

This invention relates to curtain draping hardware and to a method for draping a curtain that provides a custom designed look. A typical curtain hangs from a horizontal rod attached to a wall. As an embellishment, the center portion of the curtain can be draped in one or more arcs (also known as swags), which may be folded into pleats to obtain a decorative look. Alternatively, or in addition to forming an arc, the curtain can contain a tail or a vertical portion of fabric on one or both sides of the curtain, in order to frame the window with decorative material. The curtain can be kept in place by separate hooks or holders affixed to the wall or the curtain rod. The curtain may also be kept in place by rings through which the curtain must be threaded, and the rings then placed on separate fixtures or on the curtain rod itself. These embellishments, however, typically require a considerable amount of time and skill in order to successfully drape the curtain so that it has a neat appearance. Draping the curtain can take more than one person and it is difficult to keep the fabric taut and neat. The present hardware and method provide a draped curtain comprising a curtain rod and a curtain holder that can be installed quickly and easily by one person.

SUMMARY OF THE INVENTION

In order to achieve a desired draped curtain with a neat appearance, this invention provides curtain draping hardware and a method of draping the curtain that allows one person to quickly and easily accomplish the installation. The method uses attachment means to attach the fabric of the curtain to a curtain rod, thereby covering the front of the curtain rod. Portions of the curtain are placed in a U-shaped portion of one or more curtain holders. Each curtain holder includes a hook portion by which the holder is easily and releasably attached to the curtain rod. The curtain holder does not require a right-handed or left-handed design, thereby reducing inventory requirements and making installation simpler. Using the hardware and method of this invention enables installation of a curtain that can contain one or more arcs or a tail on one or both sides of the curtain. A decorative accent piece is provided that attaches to the curtain rod to provide a complete look.

The method described herein allows a draped curtain to be installed quickly and easily without the need for special skills. The method uses conventional curtain rods and curtain fabric to form a decorative window treatment. One or more arcs are formed which can be folded into neat, uniform pleats to complete the draped look. Tails in the curtain can also be formed neatly and easily. The tails can be used to frame and provide a decorative look to a window or other wall opening.

Thus, an object of this invention is to provide a method for draping a curtain that is inexpensive and can be achieved easily by one person without any specialized skills.

It is another object of this invention to provide a method for draping a curtain that forms one or more decorative arcs over a window with neat, uniform pleats.

It is still another object of this invention to provide a method for draping a curtain that forms one or two tails or vertical portions.

It is still another object of this invention to provide a method for draping a curtain that is easily adjusted so that different combinations of arcs and/or tails can be created.

It is still another object of this invention to provide a method for draping a curtain that covers a curtain rod or cornice with the curtain quickly and easily.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
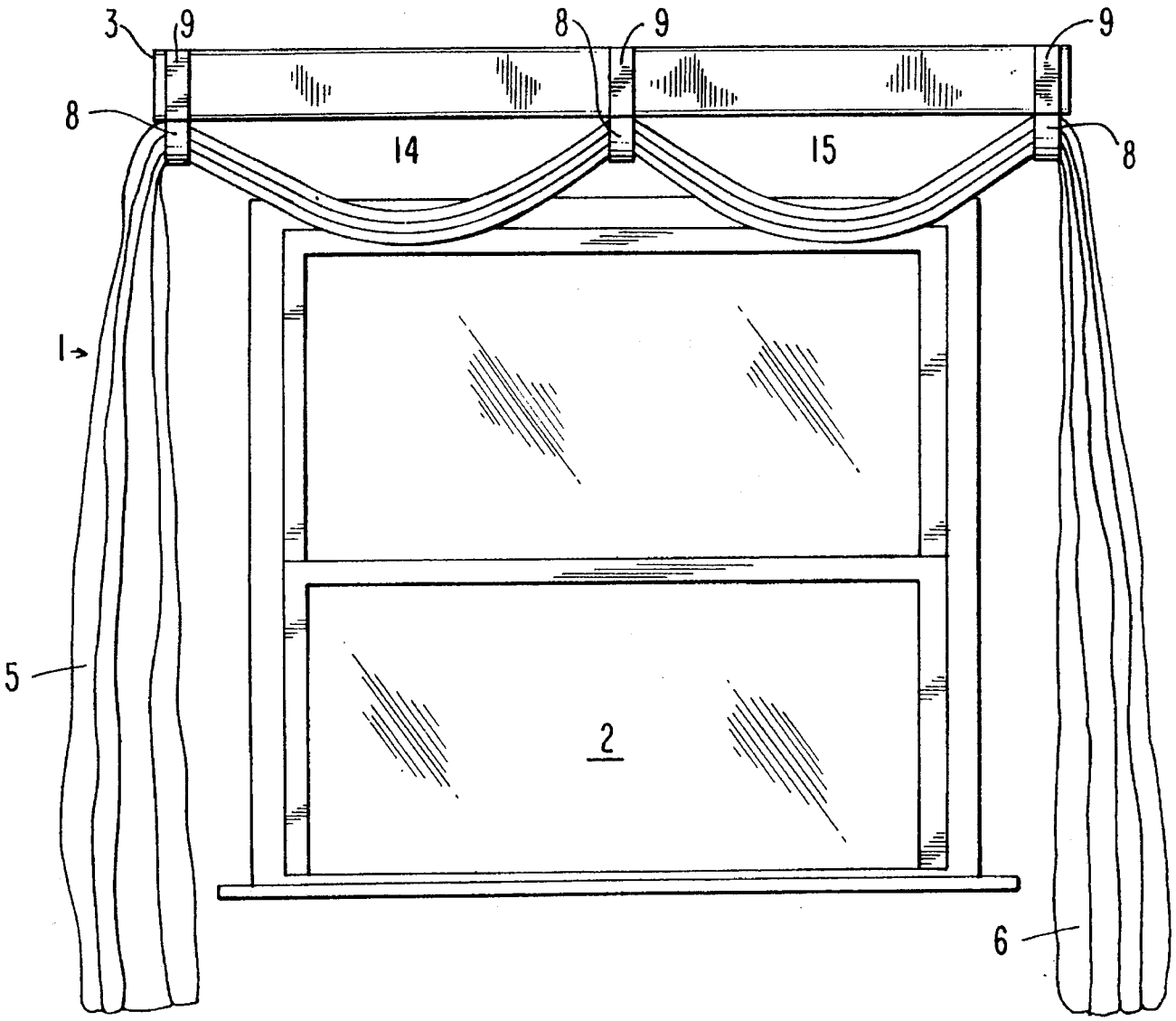
FIG. 1 is an elevational front view of an embodiment of the invention showing a resulting decorative draped curtain for a window.
Figure 2:
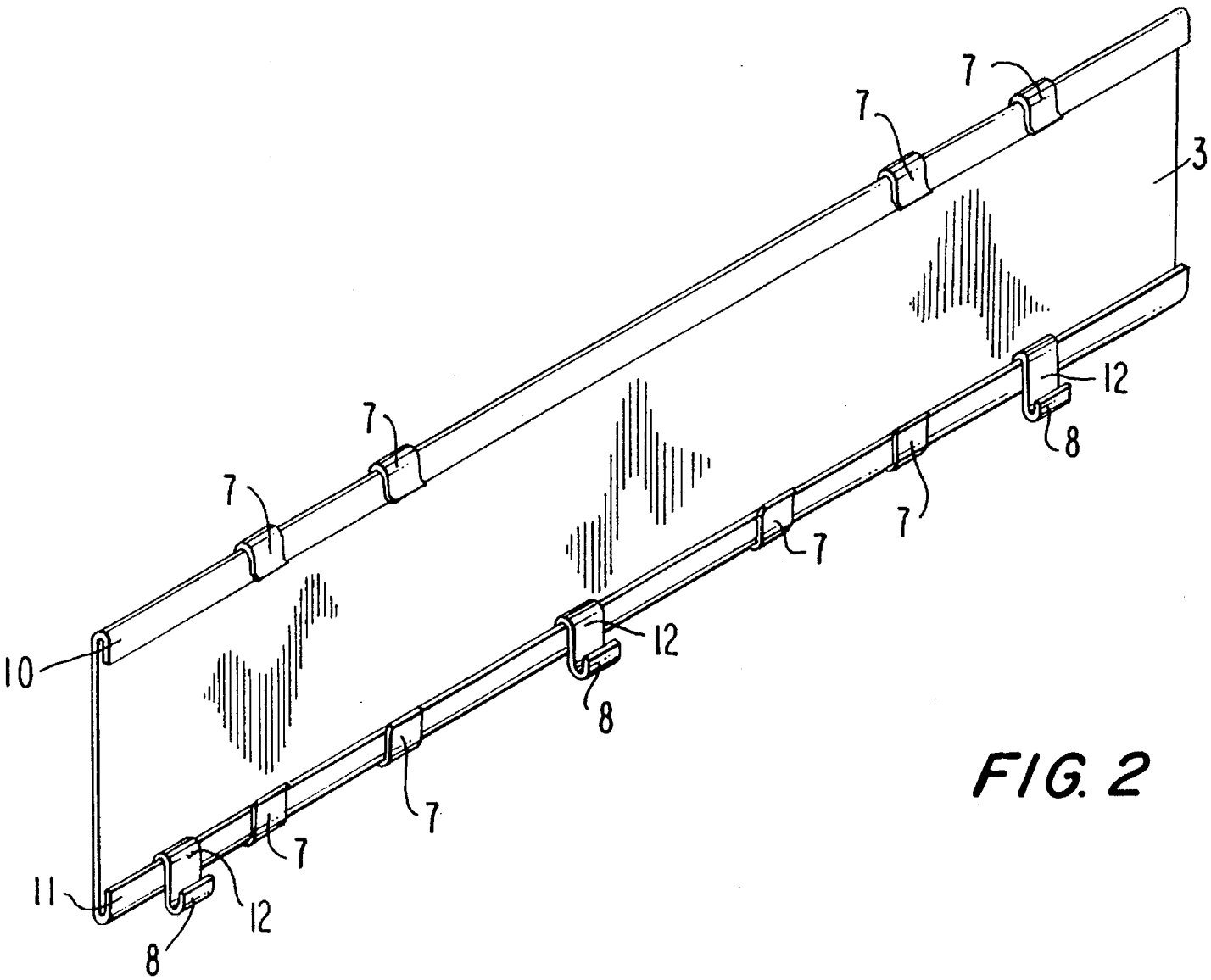
FIG. 2 is a top, rear, right-side perspective view with a curtain rod, three curtain holders and eight curtain clips showing an embodiment of the invention with the curtain removed.
Figure 3:
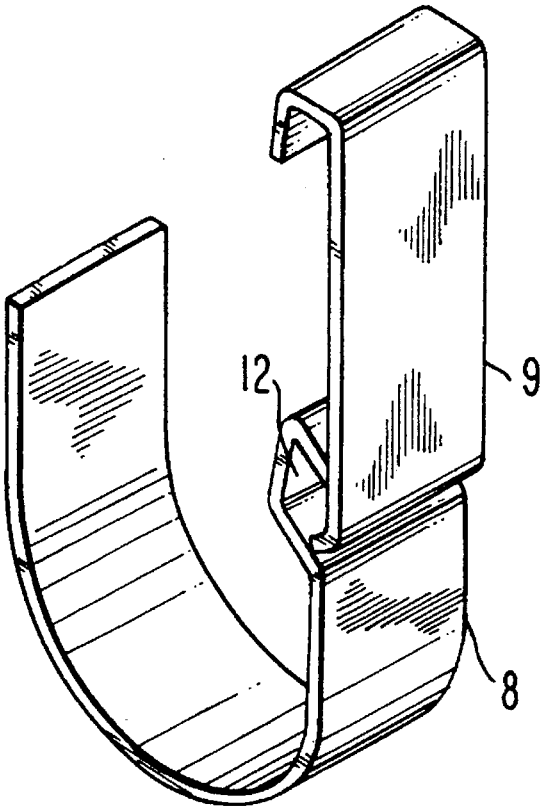
FIG. 3 is a top, front, left-side perspective view of the embodiment of a curtain holder and an accent strip of FIG. 1. The curtain, the curtain clips and the curtain rod of FIG. 1 have been removed.

FIG. 1 shows a draped curtain 1 hung from a curtain rod 3, over a window 2, having two arcs 14 and 15 of curtain fabric and two tails 5 and 6 arranged in accordance with the present invention. FIG. 2 is a perspective rear view of an embodiment of the invention with the curtain fabric removed showing the components used for practicing this invention. These components include a curtain rod 3, one or more curtain holders 8, and curtain attachment means, shown in FIG. 2 as comprising a plurality of curtain clips 7. An accent piece 9 to the curtain holder may also be used (FIGS. 1 and 3).

The draped curtain is installed by following a sequence of steps. One installing the curtain may vary the sequence of steps and achieve the same result.

Figure 4:
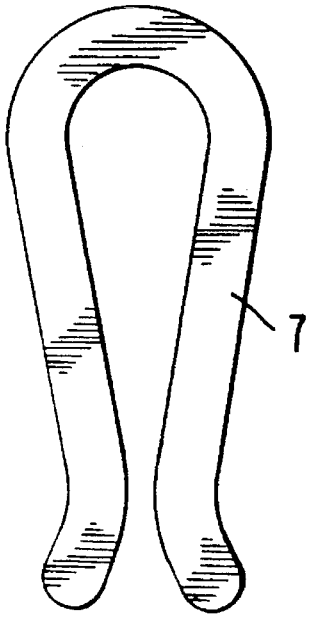
FIG. 4 is a cross-sectional view of the curtain clip of FIG. 2.

A curtain rod 3 and curtain attachment means that are of a conventional configuration, well known to those skilled in the art, may be used. The curtain rod may be generally rectangular, C-shaped or round in cross section, although other cross sections will work. A specific embodiment of a curtain rod is shown in FIGS. 1 and 2. The curtain attachment means may comprise hooks, clamps, tape, glue, velcro, screws or other methods or hardware known to be useful to attach fabric to things. A specific embodiment of a curtain attachment means is a plurality of curtain clips as shown in FIGS. 2 and 4.

A fabric curtain is made that will cover the curtain rod and form the curtain. The curtain is hemmed and selected to be of a certain dimension in order to provide the desired look. For example, the length of the curtain greater than the width of the window will provide tails. The longer the curtain, the longer the tails will be. Similarly, the wider the curtain, the more material is available to provide an arc. The more width the curtain has, the fuller the arc will be.

The curtain is placed hem side up on a flat surface and any creases in the fabric are removed. The curtain rod is placed face down over the curtain in the desired position. The curtain is then attached to the curtain rod by attachment means, which have been described earlier.

For example, using the embodiment of the curtain rod 3 of FIGS. 1 and 2, the curtain 1 is placed on a flat surface and the curtain rod 3 is placed over it. The curtain is attached to the back of the curtain rod by first tucking the upper end of the curtain into the upper lip 10 of the curtain rod 3. Then, a plurality of curtain clips 7 of FIGS. 2 and 4 are attached to the upper lip 10 of the curtain rod 3 over the curtain. The curtain clips 7 thus hold the curtain in place and attach the curtain 1 to the curtain rod 3. The curtain 1 is brought around the front face of the curtain rod 3, and a portion of the curtain is then tucked behind the curtain rod 3 and into the lower lip 11 of the curtain rod 3. As with the upper lip, a plurality of the curtain clips 7 of FIGS. 2 and 4 are attached to the lower lip 11 of the curtain rod 3 over the curtain. These curtain clips also hold the curtain 1 in place over the curtain rod 3. As a result, the front of the curtain rod is covered by curtain. The curtain clips 7 of this embodiment releasably attach the curtain. In the embodiment shown, the curtain rod 3 is flat and thus the curtain 1 and curtain rod 3 form a decorative cornice when viewed from the front (FIG. 1). This embodiment provides a rapid and simple method of providing a complete fabric appearance to the curtain rod. The curtain 1 should be attached first to the center of the curtain rod 3, and then slowly attached in stages, working towards the end of the curtain rod. This is to ensure the curtain is attached tightly to the curtain rod with no creases present.

The curtain rod, with the curtain now attached, is attached to the wall by brackets or other support (not shown). To form a tail, the curtain fabric hanging off of one of the ends of the curtain rod 3 is gathered and placed into a curtain holder 8 which is attached to the curtain rod. The curtain at this end thus forms a tail 5. The portion of the curtain in the tail can be arranged to provide a neat appearance. As the curtain holder is open where the curtain material is inserted, there is no need to thread the curtain material through a ring, nor is any other hardware required. In the embodiment shown in FIGS. 1, 2 and 3, the curtain holder has a U-shaped portion for holding the curtain. In this embodiment, the curtain holder is attached to the curtain rod by hooking the hook 12 of the curtain holder 8 to the lower lip 11 of the curtain rod 3. This embodiment allows the curtain holder to be attached anywhere along the curtain rod. Other methods of attachment, such as by screws, other hooks, latches or other known means may be used.

The same method of forming the tail can be repeated with a second curtain holder at the opposite end of the curtain rod to create a second tail 6. If the curtain is of a wide enough width, an arc is formed in the center of the curtain when the two curtain holders are placed one on each end.

If desired, additional curtain holders may be used between the two ends of the curtain. For example, with a third curtain holder, the fabric in the center of the curtain rod that is hanging down in an arc is neatly gathered and placed in the third curtain holder that is attached to the center of the curtain rod. This forms two arcs 14 and 15. The portion of the curtain in the arc can be arranged to provide neat, uniform pleats. More curtain holders can be added as with the third curtain holder to create more arcs. For example, fourth and fifth curtain holders could be added, one on each side of the third curtain holder. This would create a total of four arcs in the curtain. In the embodiments of the Curtain rod 3 and curtain holder 8 shown, these arcs can be created anywhere along the curtain rod 3 because a curtain holder 8 can be attached anywhere along the length of the curtain rod 3.

An accent piece 9 can be attached on the curtain rod directly or vertically above each curtain holder or by itself. When the accent piece is made of the same or a complementary material to the curtain holder, the accent piece can be used to provide a complete, decorative look to the curtain holder and the draped curtain.

Accordingly, it will be understood that the invention is not limited to the specific construction or arrangement of parts shown but that they may be widely modified within the invention as defined by the claims.

What is claimed is:

1. A method for draping a curtain comprising the steps of:

attaching a curtain to a curtain rod by attachment means, wherein the curtain rod comprises a lower lip, and whereby the front of the curtain rod is covered by the curtain, attaching a curtain holder to the lower lip of the curtain rod by releasable attachment means, wherein the curtain holder may be disposed at any one of a plurality of positions along the length of the curtain rod, wherein the curtain holder may be moved along the length of the curtain rod to another of the plurality of positions along the curtain rod, and wherein the curtain holder may be removed from the curtain rod by releasing the releasable attachment means from the lower lip of the curtain rod, and gathering a portion of the curtain and placing the portion in the curtain holder.

2. The method for draping a curtain of claim 1 further comprising the steps of:

attaching a second curtain holder to the lower lip of the curtain rod by releasable attachment means, positioning the second curtain holder at the center of the curtain rod, and gathering a portion of the curtain at the center of the curtain rod and placing it in the second curtain holder, whereby an arc is created.

3. The method for draping a curtain of claim 1 further comprising the step of:

attaching the curtain to the curtain rod by a plurality of curtain clips, thereby covering the front of the curtain rod with the curtain and forming a cornice.

4. The method for draping a curtain of claim 3 wherein the plurality of curtain clips releasably attach the curtain to the curtain rod.

5. The method for draping a curtain of claim 1 wherein releasable attachment means comprises a hook portion of the curtain holder, and wherein the hook portion is hooked to the lower lip of the curtain rod, and placing the portion of the curtain in the curtain holder comprises placing the portion of the curtain into a U-shaped portion of the curtain holder.

6. A method for draping a curtain comprising the steps of:

attaching a curtain to a curtain rod by attachment means, wherein the curtain rod comprises a lower lip, and whereby the front of the curtain rod is covered by the curtain, attaching each of a plurality of curtain holders to the lower lip of the curtain rod by releasable attachment means, wherein each of the plurality of curtain holders may be disposed at any one of a plurality of positions along the length of the curtain rod, wherein each of the plurality of curtain holders may be moved along the length of the curtain rod to another of the plurality of positions along the curtain rod, and wherein each of the plurality of curtain holders may be removed from the curtain rod by releasing the releasable attachment means from the lower lip of the curtain rod, and gathering different portions of the curtain and placing each portion into one of the plurality of curtain holders.

7. The method for draping a curtain of claim 6 further comprising the steps of:

attaching a first curtain holder to the lower lip of the curtain rod by releasable attachment means, positioning the first curtain holder at a first end of the curtain rod, gathering a portion of the curtain from the first end of the curtain rod and placing it in the first curtain holder, whereby a first curtain tail is created, attaching a second curtain holder to the lower lip of the curtain rod by releasable attachment means, positioning the second curtain holder at a second end of the curtain rod that is the opposite end to the first end, and gathering a portion of the curtain from the second end of the curtain rod and placing it in the second curtain holder, whereby a second curtain tail is created.

8. The method for draping a curtain of claim 7 further comprising the steps of:

attaching a third curtain holder to the lower lip of the curtain rod by releasable attachment means, positioning the third curtain holder at the center of the curtain rod, and gathering a portion of the curtain at the center of the curtain rod and placing it in the third curtain holder, whereby two arcs are created in the curtain between the first and second curtain holders.

9. The method for draping a curtain of claim 6 further comprising the step of:

attaching the curtain to the curtain rod by curtain clips, thereby covering the front of the curtain rod with the curtain and forming a cornice.

10. The method for draping a curtain of claim 9 wherein the plurality of curtain clips releasably attach the curtain to the curtain rod.

11. The method for draping a curtain of claim 6 wherein:

releasable attachment means comprises a hook portion of each of the plurality of curtain holders, wherein the hook portion of each of the plurality of curtain holders is hooked to the lower lip of the curtain rod, and placing each portion of the curtain into one of the plurality of curtain holders comprises placing each portion of the curtain into a U-shaped portion of one of the plurality of curtain holders.

12. A draped curtain comprising:

a curtain rod having a lower lip, a curtain, attachment means for attaching the curtain to the curtain rod, whereby the front of the curtain rod is covered by the curtain, a curtain holder that holds a portion of the curtain, the curtain holder being attached to the lower lip of the curtain rod by releasable attachment means, wherein the curtain holder may be disposed at any one of a plurality of positions along the length of the curtain rod, wherein the curtain holder may be moved along the length of the curtain rod to another of the plurality of positions along the curtain rod, and wherein the curtain holder may be removed from the curtain rod by releasing the releasable attachment means from the lower lip of the curtain rod.

13. The draped curtain of claim 12 wherein the curtain holder holds a portion of the curtain from the center of the curtain rod, wherein the curtain holder is attached to the lower lip of the curtain rod by releasable attachment means, and wherein the curtain holder is positioned at the center of the curtain rod.

14. The draped curtain of claim 12 wherein the attachment means comprises:

a plurality of curtain clips that are attached to the curtain rod to hold the curtain in place.

15. The draped curtain of claim 12 wherein each of the plurality of curtain clips releasably attaches to the curtain rod.

16. The draped curtain of claim 12 wherein the curtain holder is a single piece, and wherein the curtain holder comprises:

an open generally U-shaped portion for holding the portion of the curtain, and releasable attachment means comprising a hook portion for releasably attaching the curtain holder to the lower lip of the curtain rod.

17. A draped curtain comprising:

a curtain rod having a lower lip, a curtain, attachment means for attaching the curtain to said curtain rod, whereby the front of the curtain rod is covered by the curtain, a plurality of curtain holders, each curtain holder holding a different portion of the curtain, and each curtain holder being attached to the lower lip of the curtain rod by releasable attachment means, wherein each of the plurality of curtain holders may be disposed at any one of a plurality of positions along the length of the curtain rod, wherein each of the plurality of curtain holders may be moved along the length of the curtain rod to another of the plurality of positions along the curtain rod, and wherein each of the plurality of curtain holders may be removed from the curtain rod by releasing the releasable attachment means from the lower lip of the curtain rod.

18. The draped curtain of claim 17 further comprising:

a first curtain holder that holds a portion of the curtain from a first end of the curtain rod, the first curtain holder being attached to the lower lip of the curtain rod by releasable attachment means, and being positioned at the first end of the curtain rod, and a second curtain holder that holds a second portion of the curtain from a second end of the curtain rod that is the opposite end to the first end, the second curtain holder being attached to the lower lip of the curtain rod by releasable attachment means, and being positioned at the second end of the curtain rod.

19. The draped curtain of claim 18 further comprising:

a third curtain holder that holds a portion of the curtain from the center of the curtain rod, the third curtain holder being attached to the lower lip of the curtain rod by releasable attachment means, and being positioned at the center of the curtain rod.

20. The draped curtain of claim 17 wherein the attachment means comprises:

a plurality of curtain clips that are attached to the curtain rod to hold the curtain in place.

21. The draped curtain of claim 20 wherein the curtain clips releasably attach the curtain to the curtain rod.

22. The draped curtain of claim 17 wherein each of the curtain holders is a single piece and wherein each of the curtain holders comprises:

an open generally U-shaped portion for holding the portion of the curtain, and releasable attachment means comprising a hook portion for releasably attaching the curtain holder to the lower lid of the curtain rod.

* * * * *